US006595102B2

(12) United States Patent
Stevens et al.

(10) Patent No.: US 6,595,102 B2
(45) **Date of Patent: *Jul. 22, 2003**

(54) REACTIVE PERSONNEL PROTECTION SYSTEM AND METHOD

(75) Inventors: David J. Stevens, San Antonio, TX (US); Kirk A. Marchand, San Antonio, TX (US); Thomas J. Warnagiris, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/147,388

(22) Filed: May 16, 2002

(65) Prior Publication Data

US 2002/0152881 A1 Oct. 24, 2002

Related U.S. Application Data

(60) Division of application No. 09/464,791, filed on Dec. 16, 1999, now Pat. No. 6,412,391, which is a continuation-in-part of application No. 08/855,895, filed on May 12, 1997, now Pat. No. 6,029,558.

(51) Int. Cl.[7] ..... F41H 5/007

(52) U.S. Cl. ..... 89/36.17; 89/36.02; 280/735; 280/736

(58) Field of Search ..... 89/36.17, 36.02; 280/735, 736

(56) References Cited

U.S. PATENT DOCUMENTS

| | | | | |
|---|---|---|---|---|
| 3,684,309 A | | 8/1972 | Uchiyamada et al. | |
| 3,687,213 A | | 8/1972 | Sato et al. | |
| 3,703,702 A | | 11/1972 | Arai | |
| 3,778,823 A | | 12/1973 | Sato et al. | |
| 3,861,710 A | | 1/1975 | Okubo | |
| 3,893,368 A | | 7/1975 | Wales, Jr. | |
| 4,782,735 A | | 11/1988 | Mui et al. | 89/36.07 |
| 4,856,436 A | | 8/1989 | Campbell | |
| 5,012,742 A | | 5/1991 | Jones | |
| 5,327,811 A | | 7/1994 | Price et al. | |
| 5,370,035 A | | 12/1994 | Madden, Jr. | |
| 5,392,686 A | | 2/1995 | Sankar | |
| 5,398,185 A | | 3/1995 | Omura | |
| 5,435,226 A | | 7/1995 | McQuilkin | |
| 5,451,381 A | | 9/1995 | Kishimotot et al. | |
| 5,478,109 A | | 12/1995 | Faigle et al. | |
| 5,483,449 A | | 1/1996 | Caruso et al. | |
| 5,540,461 A | | 7/1996 | Nitschke et al. | |
| 5,578,784 A | | 11/1996 | Karr et al. | 89/36.03 |
| 5,584,507 A | | 12/1996 | Khandhadia et al. | |
| 5,646,613 A | | 7/1997 | Cho | |
| 5,739,458 A | | 4/1998 | Girard | 89/36.02 |
| 5,790,404 A | | 8/1998 | Fave et al. | |
| 5,792,976 A | | 8/1998 | Genovese | 102/293 |
| 5,934,381 A | | 8/1999 | Larsen | 169/56 |
| 5,964,815 A | | 10/1999 | Wallace et al. | 180/282 |
| 6,029,558 A | * | 2/2000 | Stevens et al. | |

FOREIGN PATENT DOCUMENTS

| | | | | |
|---|---|---|---|---|
| GB | 2200437 A | | 8/1988 | |
| GB | 2 234 334 A | * | 1/1991 | 89/36.17 |

* cited by examiner

*Primary Examiner*—Stephen M. Johnson
(74) *Attorney, Agent, or Firm*—Baker Botts L.L.P.

(57) ABSTRACT

A counter-terrorism, reactive personnel protection system which detects the presence of a destructive object as it approaches a designated personnel target along an intersecting path. Before impact, an air bag is rapidly inflated and interposed between the destructive object and the target so as to provide a protective barrier. The air bag is constructed from polyethylene material or other anti-ballistic materials, and serves to halt or redirect the detected destructive force of the object and thereby protect the designated target from attack.

10 Claims, 6 Drawing Sheets

REACTIVE PERSONNEL PROTECTION SYSTEM AND METHOD

CROSS-REFERENCING TO RELATED APPLICATIONS

This application is a divisional from U.S. patent application Ser. No. 09/464,791, filed on Dec. 16, 1999 by David J. Stevens et al., and entitled "REACTIVE PERSONNEL PROTECTION SYSTEM AND METHOD" now U.S. Pat. No. 6,412,391 which is a continuation-in-part of U.S. patent application Ser. No. 08/855,895 filed May 12, 1997 by David J. Stevens et al., and entitled "REACTIVE PERSONNEL PROTECTION SYSTEM", now U.S. Pat. No. 6,029,558 and for which reexamination has been requested under Ser. No. 90/006,270.

FIELD OF THE INVENTION

This invention relates generally to the field of apparatus and methods for shielding the body from hostile activity, including objects or projectiles fired from a gun or resulting from bomb explosions. More particularly, this invention relates to an apparatus and method for the automated introduction of a protective, inflatable shield between the impacting force of an object, and the body of the person at which it is directed, purposefully or otherwise.

DESCRIPTION OF THE RELATED ART

Many different approaches to the protection of personnel from life-threatening attacks exist. Examples include bullet-proof glass, concrete and steel building structures, armored cars, bullet-proof jackets, and others. The particular avenue taken depends on whether the person to be protected is stationary, located in a vehicle, located within a building, or is required to maintain mobility outside the confines of any specific stationary structure.

Many law enforcement agencies have the designated task of protecting public figures from terroristic attacks. Most often this protection is achieved through some combination of passive personnel armor (e.g., previously mentioned bullet-proof apparel, etc.), identification and control of potential sniper vantage points, and passive protection such as shields, bullet-proof glass, armor plates, and other devices. Since public figures often desire high visibility and unrestricted access to the public, traditional protective screens and placement of protective personnel in close proximity are often not practical or effective.

What is needed, therefore, is an unobtrusive, reactive device that provides adequate intervening protection between a person and rapidly-approaching, potentially lethal objects. The reactive personnel protection device should be capable of detecting incoming ballistic projectiles or other objects traveling at high speed toward a person, discriminating the presence of the incoming, dangerous object from other airborne particles or objects, activating/deploying a suitable protective device, and reducing or eliminating the risk of impact between the object and the person. Also needed is a method for protecting persons from airborne, dangerous objects resulting from explosions, ballistic activity, and other events. The system and method should make use of readily available materials, should be capable of cost-effective implementation, and should be effective with respect to a wide variety of possible dangerous, destructive airborne objects or particles.

SUMMARY OF THE INVENTION

Public officials, military personnel, and civilian leaders are often exposed to a wide range of physical threats. While existing passive protection devices are somewhat effective in detecting destructive events and the impending impact of dangerous objects, each approach has its own limitations. The most likely threats currently encountered are the result of high explosives, detonated within a building or at some short distance from a building, and small arms fire (e.g. an assassination attempt). The invention herein described provides a robust, unobtrusive, and easily installed apparatus which acts to defeat such threats after detonation of a bomb, or discharge of a weapon, etc.

The present invention includes a system and method for reactive personnel protection. The system includes a destructive object detection system, at least one rapidly deployable air bag, and a gas generating system to rapidly deploy the air bag when triggered by detection of the approach of a destructive object in proximity to a selected person or location. The destructive object may be a ballistic projectile, a bomb fragment, or any other type of debris, particle, or non-differentiated object which is traveling at a relatively high rate of speed toward a selected person/location.

The destructive object detection system is preferably radar-based, and may use anti-jamming electronics to detect the presence of incoming dangerous objects in the presence of noise, or non-destructive objects. Such discrimination functions help prevent the occurrence of false alarms.

The rapidly deployable air bag is typically constructed from Kevlar™ or Spectra™ fabric, which can be considered as specific types of woven ballistic fabric, polymeric fabric, such as polyethylene, or aramid fiber fabric. The air bag, deployed in a quasi-instantaneous fashion, acts to prevent the impact of a destructive object upon a person, and often operates by redirecting the object in order to accomplish the objective.

The gas generation system, often housed in the same container holding the air bag, is used to fill and deploy the air bag. Multiple air bags, and/or multiple generators, may also be employed, depending on the system requirements. The air bag may also be deployed over a door opening to a room to protect persons inside the room.

The method of the invention, which operates to reactively protect personnel from the approach of a destructive object by rapid deployment of an air bag prior to arrival of the object at the location of the person or persons to be protected, comprises the steps of: detecting the approach of the destructive object; discriminating the presence of the object with respect to electronic noise, and/or non-destructive objects; activating a gas generation system triggered by discrimination of the destructive object presence; and rapid deployment of the air bag so as to deploy the inflated air bag between the object and the person or persons to be protected. This deployment is in direct response to activation of the gas generation system. The method may include the step of placing or deploying the bag across the door of a room to protect the person or persons inside the room.

DETAILED DESCRIPTION OF THE INVENTION

Figure 1A:
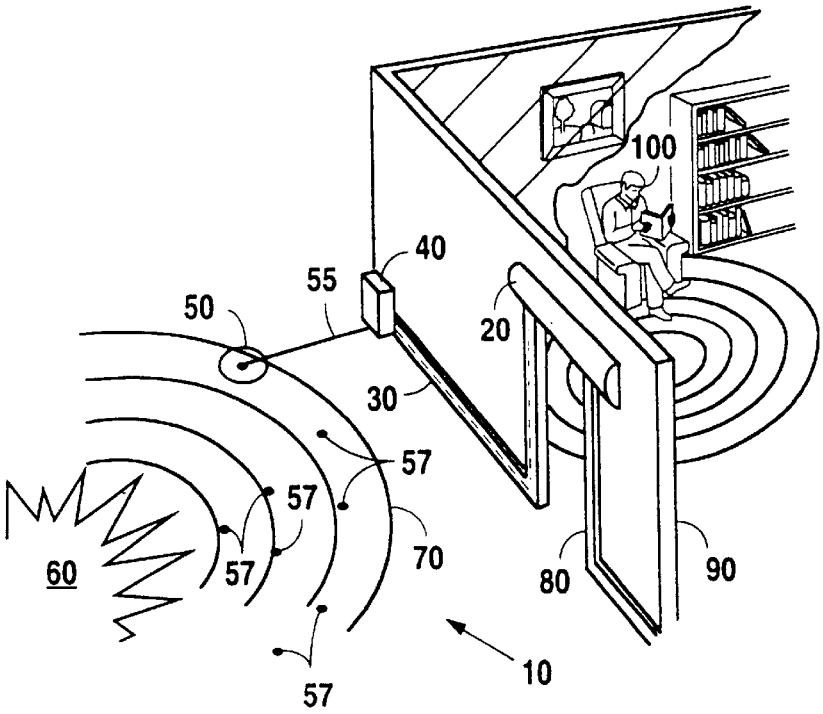
FIG. 1*a* is a perspective view of one embodiment of the present invention before air bag deployment.

Turning now to FIG. 1A, a perspective view of one embodiment of the present invention can be seen. This view depicts the state of the apparatus of the present invention prior to detection of one or more destructive objects or fragments 57 which become airborne and attain significant velocity as a result of a concussive (blast) pressure wave. Person 100 is shown seated in a room 90 having doorway opening 80. Sensor 50 is placed at some distance away from the air bag enclosure 20 sufficient to ensure that the fragments 57 emanating from explosion 60 will not reach person 100 before the air bag 25 of the reactive personnel protection system 10 can be fully activated.

Figure 1B:
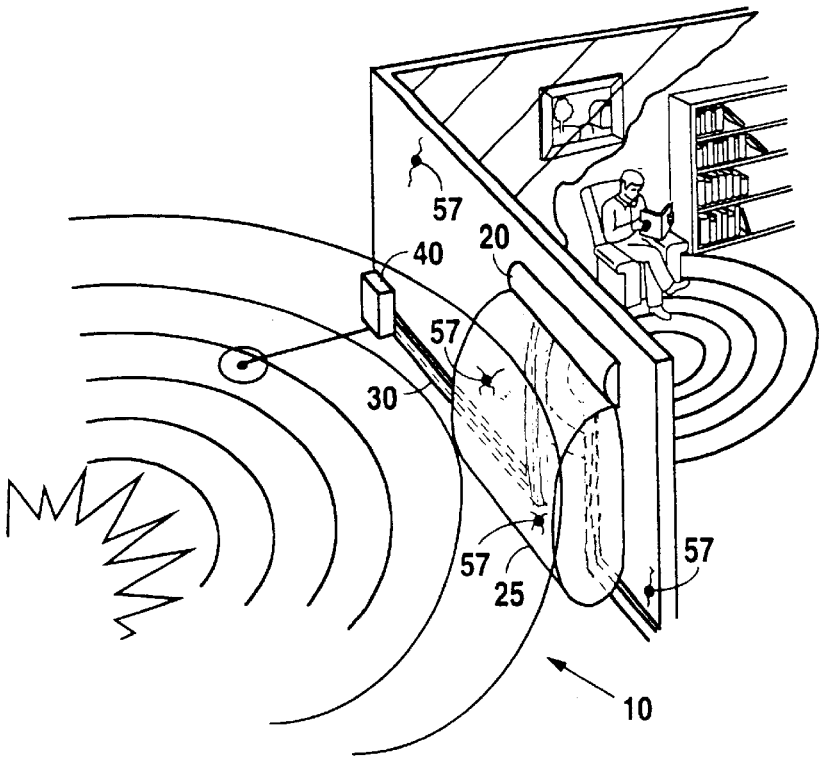
FIG. 1*b* is a perspective view of one embodiment of the present invention after detection of the approach of a destructive object.

Referring now to FIG. 1B, the deployed condition of the present invention can be seen. Since sound normally travels at a speed of 1,025 ft./sec. at sea level, and it may take the air bag 25 approximately 30 milliseconds (msec.) to deploy, the minimum distance that sensor 50 should be placed from the enclosure 20, which houses the air bag 25, is about 50 ft. This gives approximately 20 msec. for the destructive object detection system (which includes sensor 50 and conduit 55) to process the signal provided by sensor 50 via sensor output conduit 55, confirm that the signal presented by the sensor 50 indicates the presence of destructive objects or fragments 57, and initiate deployment of the air bag 25 via trigger output 30.

Figure 2A:
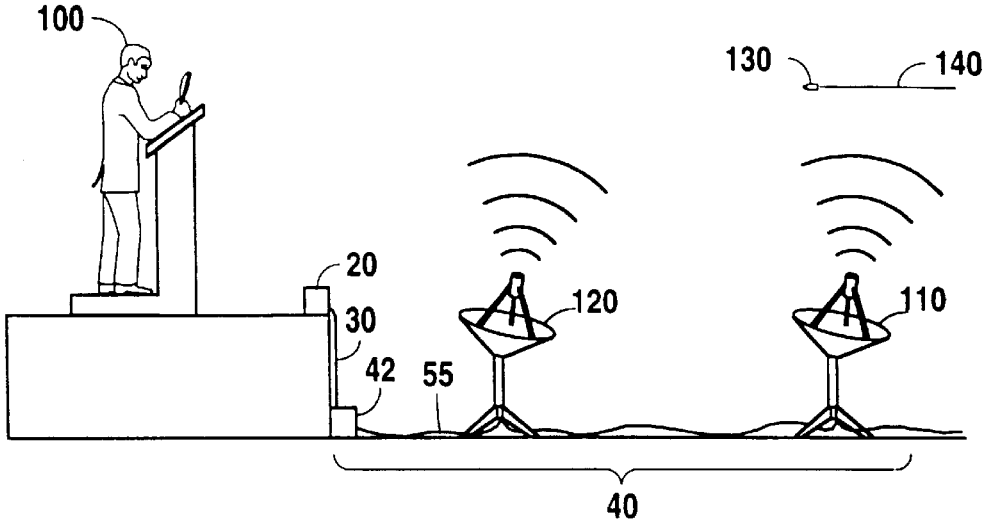
FIG. 2*a* is a perspective view of an alternative embodiment of the present invention before air bag deployment.

Turning now to FIG. 2A, a perspective view of an alternative embodiment of the present invention (used to detect the approach of a destructive object, such as a bomb fragment or a bullet 130) before the air bag 25 has been deployed, can be seen. One of the best methods for detecting the rapid approach of a bullet 130 is radar technology; acoustic-based systems are less reliable and can be defeated by silencers applied to small arms. Doppler radar systems have been used successfully as velocimeters in ballistic applications, and in general, Doppler radar systems perform well in noisy and/or geometrically complex environments. The present invention may incorporate a bi-static configuration of Doppler radar in which a separate illuminator or transmitter 110 is located at some distance from a passive receiver 120. The sensor output conduit 55 from the receiver 120 is monitored by the control unit 42 and, after suitable analysis and discrimination, trigger output 30 is activated whenever the presence of bullet 130 is detected and confirmed. Trigger output 30 is sent to enclosure 20, which houses one or more air bags 25 (not shown in this figure).

Figure 2B:
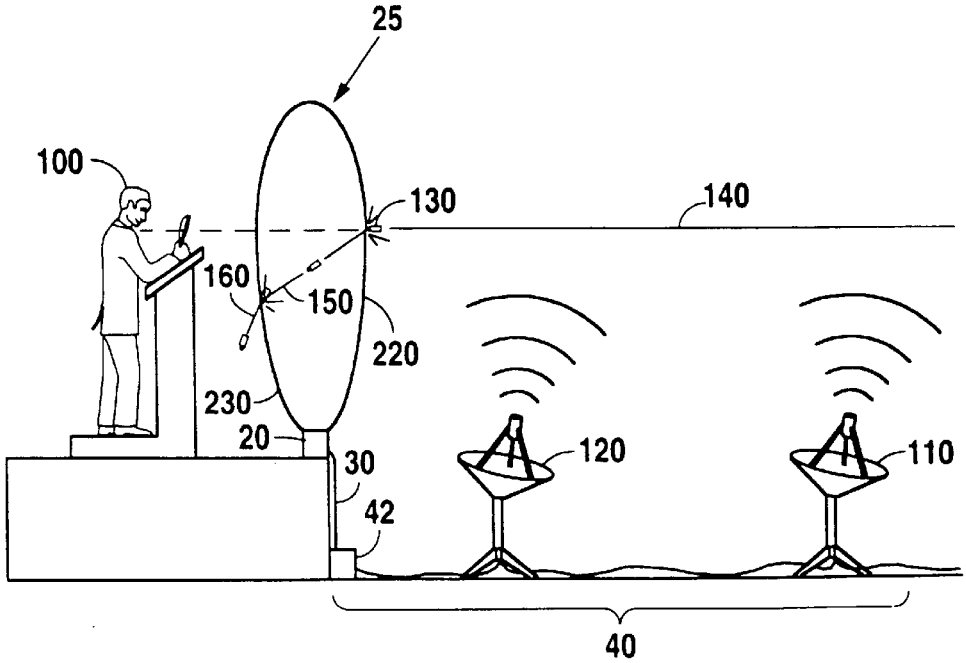
FIG. 2*b* is a perspective view of an alternative embodiment of the present invention after detecting the approach of a ballistic projectile or bomb fragment.

Turning now to FIG. 2B, the deployed condition of the alternative embodiment of the present invention (preferred for ballistic projectiles) can be seen. The initial trajectory 140 of the bullet 130 along a path which intersects with the person 100 has been detected by the receiver 120 within the destructive object detection system 40 and the air bag 25 has been rapidly deployed from the enclosure 20. For the purposes of this discussion, the term "rapid deployment" means that the anti-ballistic airbag becomes sufficiently inflated, or fully inflated, so as to effectively protect the person from an approaching destructive object, within a time period of less than about 30 msec. It should be noted that several enclosures 20, housing multiple air bags 25, can also be employed in this embodiment of the invention. Once the control unit 42 has determined the initial trajectory 140 of the fragment or bullet 130, then the appropriate air bag 25 can be deployed via trigger output 30. This figure also illustrates the intermediate trajectory 150 of the fragment or bullet 130, after it is redirected by encountering the front surface 220 of the air bag 25. The fragment or bullet 130 is further redirected by the rear surface 230 of the air bag 25 to follow the exit trajectory 160. As mentioned previously, the air bag 25 is deployed by the control unit 42 within the system 40 so as to interpose a protective shield between the initial trajectory 140 of the fragment or bullet 130, which intersects with the person 100. Detection of the object 130 does not relate to, or involve monitoring the motion of the person 100.

Lightweight materials, such as DuPont's KEVLAR® fabric and Allied Signal's SPECTRA® fabric, are available for constructing air bags to provide proper anti-ballistic protection from destructive objects. These materials can be sewn or configured in many ways to accommodate destructive object protection applications; in the present invention, the selected material is formed into air bags similar to those found in automobiles, but of larger size and thickness. The strength to weight ratio of these anti-ballistic fabrics are among the highest available, either man-made or natural. The anti-ballistic fabric used to construct the anti-ballistic air bag 25 can thus be made of aramid fibers, rubber-coated fibers, silicone-coated nylon fibers, woven polyethylene, ballistic nylon, and specialized polymeric fibers, such as poly (p-phenylene-2, benzobisoxazole) fibers. Also, such materials can be used in combination, such as combining a woven ballistic fabric and a non-woven aramid fiber shield. This method is disclosed in U.S. Pat. No. 5,237,811 issued to Price, et al. Any material which is described as a polymeric fabric, or an ultra-high molecular weight polyethylene fiber, or fabric, or any other flexible material of sufficient strength to resist puncture by destructive objects, such as typical bullet-like projectiles and fragments or particles set in motion by concussive explosion blasts can be used to implement the air bag of the instant invention. For purposes of this discussion, a "destructive object" is any airborne particle, bullet, projectile, bomb fragment, or other object which has sufficient mass and speed to impart more than about 1,000 joules of energy to a stationary human body upon impact. This definition includes all objects set in motion by mechanical force (springs, belts, catapults, etc.), nuclear fission or fusion force, electrical or magnetic force, chemical force (air, gas, etc.), and explosive forces.

Not only does the system and method of the present invention act to control the motion of explosively propelled objects, such as bullets, munition fragments, ruptured machine parts and the like, after deployment, as do some conventional object restraining systems and methods, but it also provides protection from such destructive objects by specifically detecting and discriminating their presence, and responsive thereto, deploying an anti-ballistic air bag between the approaching object and the targeted person. This is especially true with regard to detecting the approach of a destructive object along a path which intersects the targeted person.

Figure 3A:
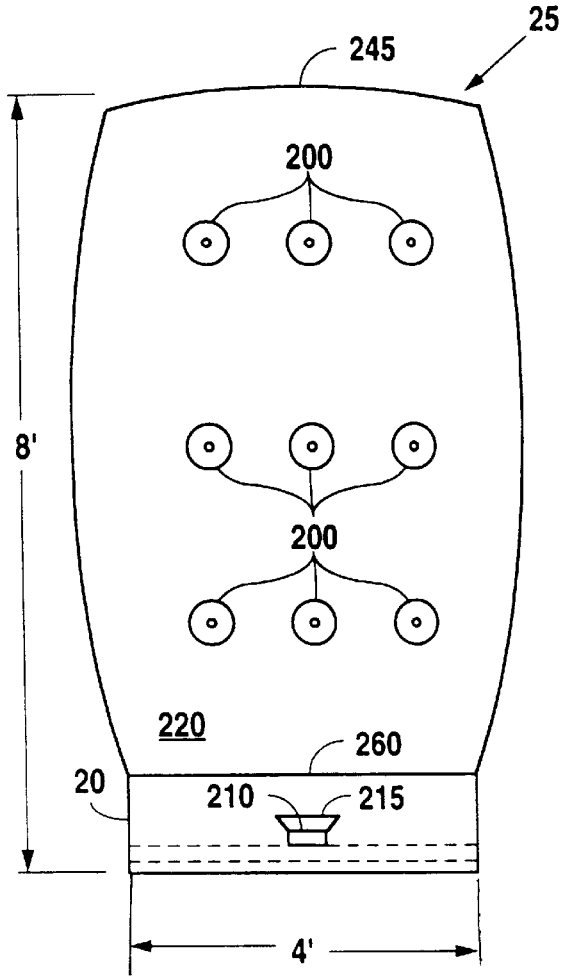
FIGS. 3*a*–3*c* are a three-view depiction of a deployed air bag.
Figure 3B:
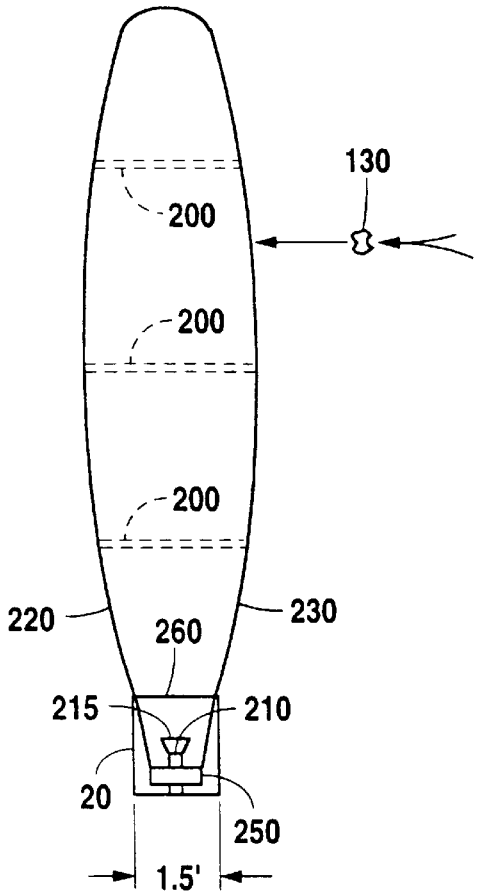
Figure 3C:
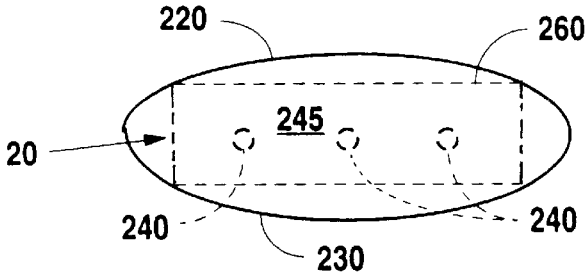

Turning now to FIG. 3, a three-view depiction of the deployed air bag 25 of the present invention can be seen. After detection and confirmation of the presence of a destructive object, such as a ballistic projectile, an activation signal is sent to a gas generator 210 so that the air bag 25 is inflated within approximately 20–30 msec. of signed receipt. Enclosure 20 has a frangible upper surface 260 through which the air bag 25 emerges when inflated by the gas generator 210. The front surface 220, the rear surface 230, and the top surface 245 of the air bag 25 are made from ultra-high molecular weight polyethylene fabric, or other fabrics, as listed above. Using such construction results in a type of spaced-plate armor system. That is, for a given level of protection, such a multi-plate system results in a lighter weight protective element, per unit area, than using a single layer, equivalent thickness of the same material.

The inflation of the air bag 25 by way of the gas generator 210 is also controlled using vents 240 and cross-ties 200. The air bag 25 should optimally be configured to remain effectively inflated and in place for at least about two seconds.

The effectiveness of the anti-ballistic air bag 25 in stopping a destructive object, such as a bullet, is a function of the thickness of the front surface 220 and the rear surface 230, as well as the distance between them. The mechanical advantage of this spaced-plate system lies in the fact that the front surface 220 slows, deforms, and re-directs the objector projectile 130 as it passes through; the slower, tumbling projectile 130 is then either halted or further re-directed by the rear surface 230 of the air bag 25.

In the present invention, any material of sufficient strength and toughness to significantly redirect a ballistic projectile along its initial trajectory can be used to construct the air bag 25. The thickness of the anti-ballistic fabric can be varied and should be chosen to match a particular threat.

The shape and dimensions of the inflated anti-ballistic air bag 25 can be modified to meet the required level of protection (e.g. destructive object size and velocity), along with area coverage requirements. As shown, the inflated anti-ballistic air bag 25 has a pillow shape, and may be sized to cover a typical doorway if used as illustrated in FIG. 1B. That is, the dimensions could be roughly 4 ft. wide by 8 ft. high by 1-½ ft. thick at the widest portion. The air bag 25 may be continuously attached to a base plate 250, located near the bottom of enclosure 20, and held in place with a pinching bar (not shown) around the periphery of the base plate 250.

The seams of the anti-ballistic air bag 25 are sewn using polyethylene, aramid, or other, similar fibers, and the structure of the air bag 25 is reinforced using cross-ties 200, also of polyethylene, aramid, or similar material so that the air bag 25 deploys vertically, rather than billowing horizontally. The size and position of the cross-ties 200 are a function of the size of the air bag 25, the required inflation time, and the size of the gas generator 210. The air bag 25 also typically contains reinforced vents 240 that are sized to control the peak pressure experienced during inflation 25 and therefore, the peak stress applied to the anti-ballistic material used to fabricate the air bag 25. Vents 240 located in top surface 245 of the air bag 25 also act to provide a downward force which acts against the base plate 250 due to vertical jetting of gas expelled through the vents 240.

The gas generator 210 is similar to that found in conventional automobiles, but typically larger in size and utilizing a faster burning oxidizer component. The generator may be similar to, or identical to, Breed Technologies Part No. 99807840, or those gas generators 210 manufactured by Pacific Scientific. As illustrated in FIG. 3, a single gas generator 210 is used. However, multiple generators 210 can be used to reduce inflation time and prolong the duration of time during which air bag 25 remains effectively deployed. The gas generator 210 is typically affixed to the base plate 250, and is surrounded by insulation 215 which provides a thermal barrier between gas generator 210, the nearby base plate 250, and the air bag 25.

Figure 4:
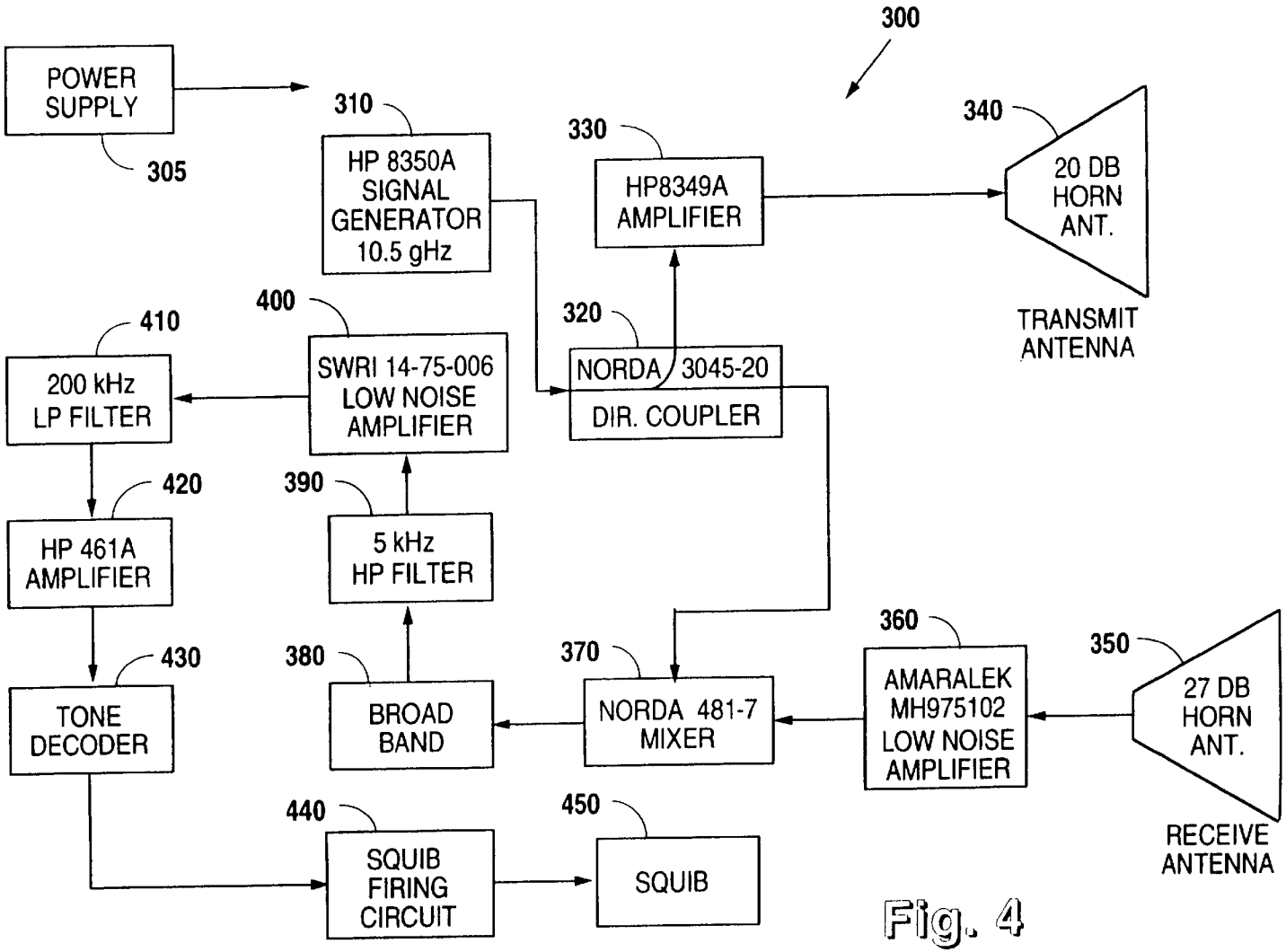
FIG. 4 is a schematic block diagram of a bi-static radar embodiment of a destructive object detection system.

Turning now to FIG. 4, a schematic block diagram of a bi-static radar detection system operating over a range of about 8 to 20 GHz, and comprising the destructive object detection system, can be seen. In this exemplary embodiment of the destructive object detection system, an analog signal processing system is illustrated, however, a RISC processor or other relatively fast digital computer can also be used to process signals from sensory components in the system to reliably detect the presence of destructive objects, such as bullets, or projectiles/fragments which become airborne on a concussive wave front, for example. A suitable detection system includes systems similar or identical to any one of the Weibel W-700 family of Doppler radar systems.

The power supply 305 is used to supply power to all components employed in the detection, discrimination, and gas generator activation circuits. In this particular embodiment, a signal generator 310 supplies a signal of about 10.5 GHz (normally continuous wave, but modulation for anti jamming and noise rejection and/or non-destructive object discrimination may be added) to a directional coupler 320. The generator signal is then amplified by an amplifier 330 and passed to a transmitting antenna 340 for illumination of incoming objects. The transmitted signal is applied to the general area surrounding personnel to be protected. The transmitting antenna 340 is operated with approximately 100 milliwatts of power at a frequency of about 10.5 GHz. The dedicated receiving antenna 350 is passive. While operation at about 10.5 GHz is preferred, frequencies ranging from about 8 GHz to about 20 GHz may be used. The bi-static system, using a separate transmitting antenna 340 and receiving antenna 350, provides greater received signal isolation and greater detection range by reducing receiver signal overload (due to spatial isolation between the respective antennae 340 and 350). Such a system also provides greater flexibility in shaping detection elevation and azimuth coverage. The receiving antenna 350 output is amplified by a low noise amplifier 360 and mixed with a sample of the signal provided by the signal generator 310 via directional coupler 320 and a mixer 370. The resulting signal, introduced into a broadband transformer 380 (North Hill Electronics, Inc. model 0016PA, or equivalent), is a Doppler-shifted beat signal. After passing the beat signal through a high pass filter 390 (optimally operating at a 3 dB point of about 6 kHz, with maximum rejection of about 100 dB at about 2 kHz), the signal is then amplified via received signal amplifier 400, further filtered by way of a low pass filter 410 (optimally acting at a 3 dB point of about 200 kHz, and having a maximum rejection of about 100 dB at about 600 kHz), further amplified using a signal amplifier 420, and passed on to a tone decoder 430. The low noise amplifier 360 should have as low a noise figure as practical without being overly sensitive to in-band intermodulation products. The broadband transformer 380 is not essential to system functionality, but is useful for isolating ground-induced noise and further limiting the received signal bandwidth to the bands of interest. The signal amplifier 400 is a low noise (S/N ration less than about 4 dB) amplifier operating at Doppler frequencies in the range of about 20 kiloHertz to about 70 kiloHertz.

The tone decoder 430 responds to a Doppler shift produced by predetermined destructive object velocities. The shift is determined by the well known equation $\Delta f=2Vf_c/C$, where $\Delta f$ is the Doppler shift, V is the velocity, $f_c$ is the continuous wave frequency, and C is the speed of light. The tone decoders can be set for a nominal center frequency and bandwidth (bandwidth should be limited to about 14% of $f_c$. The circuit values illustrated in FIG. 5 produce a response frequency which corresponds to the velocity of a 9 mm bullet, or some other destructive object, such as a bomb fragment, that travels at a similar speed. Tone decoder response time varies with the velocity of the object plus many other factors. Alternative detection methods require designing a recognition algorithm using digital signal processing of the sampled Doppler waveform. Much better sensitivity and lower false alarm rates are possible using such methods, as opposed to using simple tone decoders, which function adequately for most purposes, and provide a lower cost approach. Multiple tone decoders 430 (not shown) with overlapping frequency bands can also be used to detect a range of Doppler shift frequencies so that a corresponding range of destructive object velocities can also be detected.

This embodiment of the destructive object detection system of the present invention may be refined by using one or more transmit and receive antennas to produce a Doppler shift from destructive objects entering a well-defined volume of space. Such antennae combinations can be placed in a specific series of locations optimized for ranging and, simultaneously, for reducing the chance of false alarms produced by signal sources outside the radar field of view.

To overcome electronic jamming which may be activated to disable destructive object detection, or activation of the system through use of electromagnetic signals (either spurious or intended), anti-jamming circuitry is also included as an optional element of the present invention. Various approaches are available, including signal amplitude and frequency coding, as is well known to those skilled in the art. Such coding may include simple sinusoidal amplitude or frequency modulation, which in turn produces recognizable side bands in conjunction with the true Doppler-shifted signal; such side bands do not normally appear as the result of a jamming signal. More sophisticated coding techniques, including signal doping, can also be used, but should be evaluated in light of possible signal output delays arising from the resulting decoding constraints.

In other embodiments of the destructive object detection system, a RISC-type control processor, or other fast signal processors known in the art, may be used to conduct analyses of signals from the receiving antenna 350 after such signals have been suitably filtered and digitized. Software may be used to do simple frequency detection. In addition, algorithms may be used to recognize specific signals for verification of frequency, amplitude, modulation, and/or spectral content of the acquired signal. Redundant hardware and/or processing algorithms can also be used to confirm the presence of a ballistic projectile or bomb fragment, or other destructive object, to minimize the likelihood of accidental deployment.

Once the presence of a destructive object has been reliably detected, then the firing circuit 440 is activated. A squib 450 is located inside the gas generator 210 and is used to ignite the oxidizer therein. The gas generator 210 (or gas generators, since multiple units may be used, depending upon the application) may be a Primex 28534-301 (or equivalent) with about 68 $ft^3$ free volume and approximately 1 lb. of propellant. The generator may be initiated with a squib, such as an M-102 Atlas Match squib (or equivalent) typically using a firing signal of 3 amps or more at 12 volts for a duration of 2 msec. or longer. The tone decoder 430 can be constructed from a conventional LM567C tone decoder integrated circuit, or similar device, and is used to detect the presence of certain frequencies to determine the presence of a Doppler-shifted destructive object signal.

Figure 5:
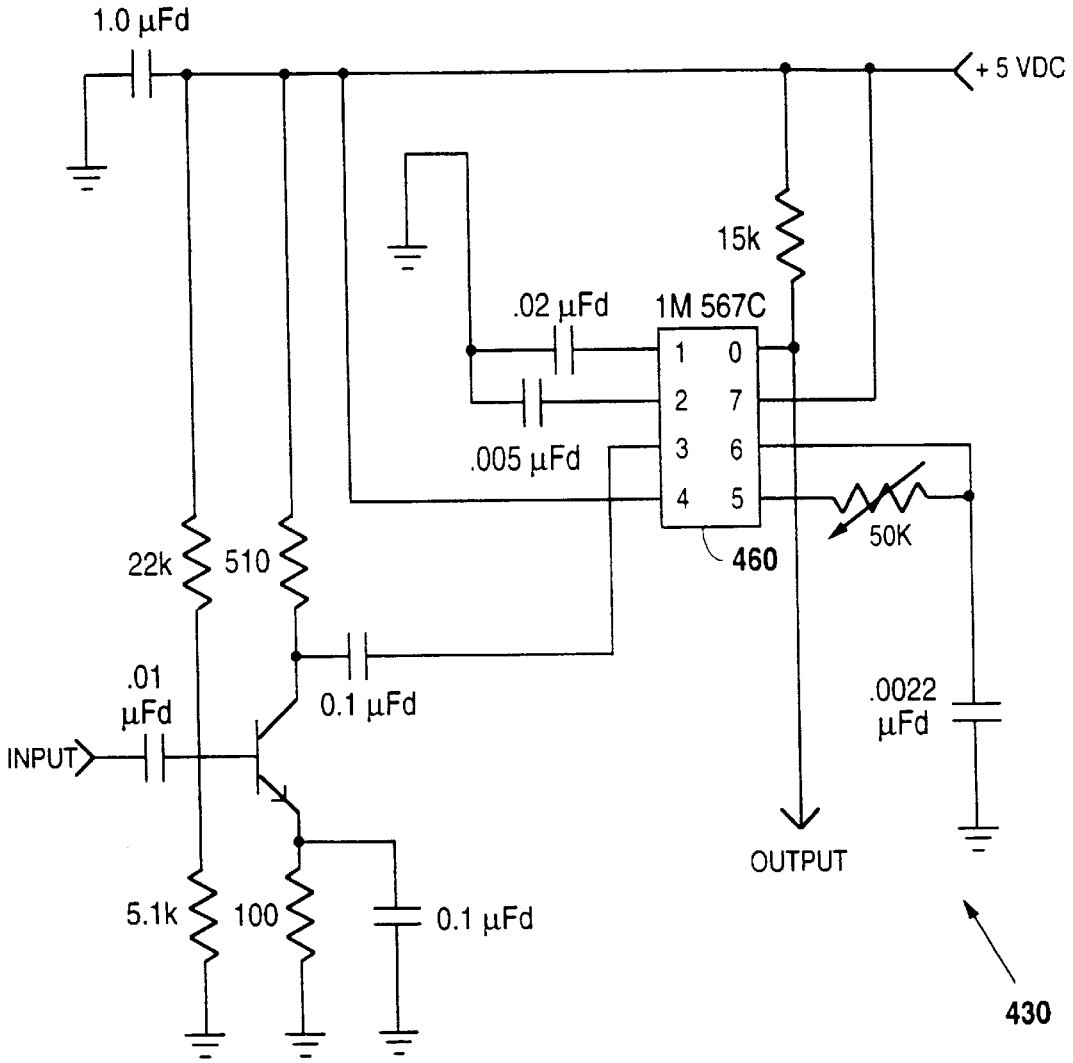
FIG. 5 is a schematic diagram for Doppler-shifted tone detection.

Turning now to FIG. 5, the circuit diagram for the tone decoder 430 is illustrated. As can be seen, a tone decoder integrated circuit 460 of type LM567C, or similar, is surrounded by conventional components, the particular values of which are illustrated on the diagram. Individual component values are determined by formulas well-known in the art, and the values shown in the figure are typical for detection of a Doppler-shifted frequency generated by a 9 mm bullet fired from a handgun. For example, it has been experimentally determined that the range of Doppler shift varies from approximately 19 Khz to 26 kHz for a 9 mm bullet traveling at speeds of 900 fps to 1200 fps, respectively. For a 5.56 mm bullet, the shift ranges from 64 kHz to 73 kHz for velocities ranging from 3,000 fps to 3,400 fps, respectively. Of course, multiple tone decoders, operating simultaneously, can be used in this particular embodiment of the present invention, any one of which is capable of activating the firing circuit 440.

Figure 6:
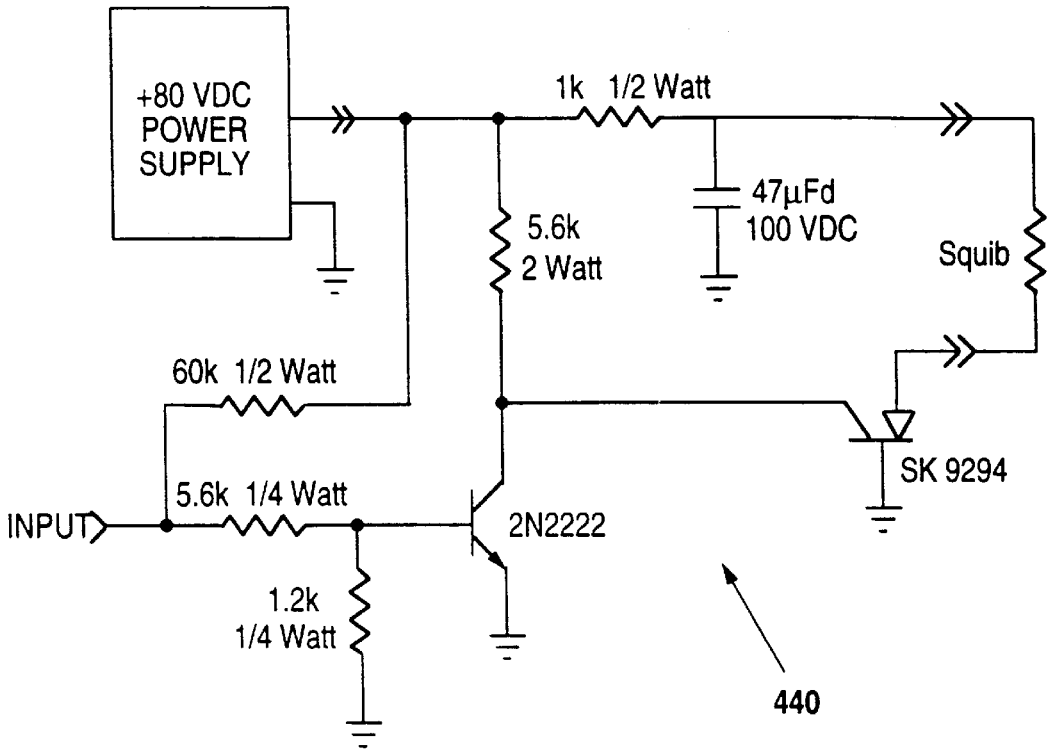
FIG. 6 is a schematic diagram of a gas-generator squib ignition circuit.

Turning now to FIG. 6, a schematic diagram of exemplary gas generator squib ignition circuitry is illustrated, using typical component values well known in the art. Generally, a signal of at least 3 amps at 12 volts must be present at the squib for a duration of 2 msec. or longer. The propagation delay involved in firing the squib after receiving the validated destructive object detection signal is approximately one msec., depending on tone decoder detection time.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

What is claimed is:

1. A reactive personnel protective system for directly shielding the body of a person, in which at least one air bag is inflated responsive to detection of a projectile prior to contact between the projectile and a person, said system comprising:

a radar detection system operable to detect the motion of the projectile when the projectile is airborne in space and to generate a sensor output signal and having a fixed location;

at least one rapidly deployable anti-ballistic air bag designed to slow and deflect the projectile; and a gas-generating system for rapid deployment of said air;

wherein the detection system is further operable to process the sensor output signal and to generate a control signal for deploying the air bag, during a processing time, and wherein the detection system processes the sensor output signal to discriminate between the projectile and other objects; and wherein the processing time is less than the flight time of the projectile between detection of the projectile and reaching the air bag.

2. The system of claim 1, wherein the projectile is a ballistic projectile.

3. The system of claim 1, wherein the projectile is a fragment resulting from an explosion.

4. The system of claim 1, wherein the detection system has a bi-static configuration.

5. The system of claim 1, wherein the detection system processes the sensor output signal to discriminate between the projectile and noise.

6. A method of shielding a person from a ballistic projectile prior to contact between the projectile and the person, comprising the steps of:

positioning at least one rapidly deployable anti-ballistic air bag in an expected flight path of the projectile toward the person, the air bag being designed to slow and deflect the ballistic projectile;

positioning a radar detection system such that the flight path is within range of the detection system, the detection system being operable to detect the motion of the projectile when the projectile is airborne in space, to generate a sensor output signal, to process the sensor output signal, and to generate a control signal for deploying the air bag, during a processing time;

wherein the radar detection system has a fixed location;

detecting the motion of the projectile;

processing the sensor output signal generated by the projectile by discriminating between the projectile and another object;

generating the control signal, and deploying the air bag.

7. The method of claim 6, wherein the detection system processes the sensor output signal to discriminate between the projectile and noise.

8. The method of claim 6, wherein the detection system has a bi-static configuration.

9. The method of claim 6, wherein the projectile is a bullet.

10. The method of claim 6, wherein the projectile is a fragment resulting from an explosion.

* * * * *